US011287145B2

(12) United States Patent
Taniyama et al.

(10) Patent No.: US 11,287,145 B2
(45) Date of Patent: Mar. 29, 2022

(54) FLUID MACHINE

(71) Applicant: Hitachi Industrial Equipment Systems Co., Ltd., Tokyo (JP)

(72) Inventors: Yuki Taniyama, Tokyo (JP); Tomoyuki Kado, Tokyo (JP); Norikazu Saitou, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 16/981,177

(22) PCT Filed: Feb. 28, 2019

(86) PCT No.: PCT/JP2019/007835
§ 371 (c)(1),
(2) Date: Sep. 15, 2020

(87) PCT Pub. No.: WO2019/176563
PCT Pub. Date: Sep. 19, 2019

(65) Prior Publication Data

US 2021/0003294 A1 Jan. 7, 2021

(30) Foreign Application Priority Data

Mar. 16, 2018 (JP) ..... JP2018-048798

(51) Int. Cl.
*F24F 1/24* (2011.01)

(52) U.S. Cl.
CPC ..... *F24F 1/24* (2013.01)

(58) Field of Classification Search
CPC ..... F04B 39/066; F04C 29/047; F24F 1/24
See application file for complete search history.

(56) References Cited

U.S. PATENT DOCUMENTS

2017/0130975 A1* 5/2017 Shoemaker ..... F24F 1/24
2020/0300246 A1* 9/2020 Sadakata ..... F04B 53/002

FOREIGN PATENT DOCUMENTS

JP 11-264391 A 9/1999
JP 2003-35260 A 2/2003
(Continued)

OTHER PUBLICATIONS

WO-2017195242-A1 Translation (Year: 2017).*
(Continued)

*Primary Examiner* — Schyler S Sanks
(74) *Attorney, Agent, or Firm* — Crowell & Moring LLP

(57) ABSTRACT

A fluid machine that performs efficient cooling of a control system, such as a control device. The fluid machine is provided with: a fluid machine body; a drive source; a control device; a housing in which the fluid machine body, the drive source, and the control device are housed; and a cooling fan. The housing has a plurality of intake openings for introducing cooling air into the interior thereof and one exhaust opening, and includes a partition wall which partitions the interior of the housing into a first compartment and a second compartment and which has a communication portion providing communication between the first compartment and a part of the second compartment. A first intake opening among the plurality of intake openings is disposed in a housing wall of the first compartment in which at least the control device is disposed, and a second intake opening is disposed in a housing wall of the second compartment in which at least the drive source is disposed. The exhaust opening discharges the cooling air that has flowed from the first intake opening into the second compartment via the communication portion and that has cooled one of the fluid machine body and the drive source, and the cooling air that has been taken in via the second intake opening. A part of the control device is disposed facing an area of the first com-
(Continued)

partment downstream of the first intake opening and upstream of the communication portion.

16 Claims, 7 Drawing Sheets

(56) References Cited

FOREIGN PATENT DOCUMENTS

| | | | | | |
|---|---|---|---|---|---|
| JP | 2005-30227 | A | | 2/2005 | |
| JP | 2010133290 | A | * | 6/2010 | ..... F04C 25/02 |
| JP | 2014-51946 | A | | 3/2014 | |
| JP | 2014051946 | A | * | 3/2014 | |
| JP | 2014-66252 | A | | 4/2014 | |
| JP | 2014066252 | A | * | 4/2014 | |
| JP | 2016-133013 | A | | 7/2016 | |
| JP | 2018-204521 | A | | 12/2018 | |
| WO | WO 2017/195242 | A1 | | 11/2017 | |
| WO | WO-2017195242 | A1 | * | 11/2017 | ..... F04B 35/06 |

OTHER PUBLICATIONS

JP-2014066252-A Translation (Year: 2014).*
JP-2010133290-A Translation (Year: 2010).*
JP-2014051946-A Translation (Year: 2014).*
Japanese-language Office Action issued in Japanese Application No. 2020-505761 dated May 7, 2021 with English translation (11 pages).
International Search Report (PCT/ISA/210) issued in PCT Application No. PCT/JP2019/007835 dated May 28, 2019 with English translation (four (4) pages).
Japanese-language Written Opinion (PCT/ISA/237) issued in PCT Application No. PCT/JP2019/007835 dated May 28, 2019 (six (6) pages).

* cited by examiner

FLUID MACHINE

TECHNICAL FIELD

The present invention relates to a fluid machine, and relates to a technology of cooling a control device that controls this machine.

BACKGROUND ART

As a fluid machine such as a compressor, an expander, a blower, or a pump device, known is a fluid machine including a package type configuration where a compressing, expanding or pumping fluid machine body and a control device or the like that controls this fluid machine body are stored in a housing. Hereinafter, the compressor that generates a compressed gas will be described as an example.

As the compressor, known is a compressor including a configuration where a compressor body that takes in a gas such as air to generate the compressed gas, a drive source (e.g., an electric motor, or an internal combustion engine), a power conversion device (an inverter) that supplies power to this source and a control device that controls an operation or the like are arranged in a housing and packaged.

Furthermore, the drive source, the power conversion device, the compressor body and a discharge pipe system of the compressor are high heating elements. Consequently, a configuration is also common which includes, as a cooling device, an air-cooled heat exchanger and a fan unit that generates cooling air to perform heat exchange with this heat exchanger.

Patent Literature 1 discloses an air-cooled package type compressor in which a package is divided into a compressor chamber including a cooler and a compressor, and a dryer chamber including a refrigeration type dryer, and the respective chambers are provided with intake openings, and both the chambers provide partial communication, to provide a flow structure where cooling air taken inside through the respective intake openings is discharged from the package through a common exhaust opening by a fan disposed in the compressor chamber. Furthermore, Patent Literature 1 discloses that a capacitor of the refrigeration type dryer disposed in the dryer chamber is also cooled by this flow of air.

Patent Literature 2 discloses a package type scroll compressor comprising a configuration where a scroll compressor body, an electric motor, a cooler that cools an operation gas and others are contained in a housing, and a space where the compressor body and the electric motor are arranged and a space where the cooler is disposed are divided via a partition plate, each of the spaces including an intake opening and an exhaust opening for the cooling air that are separately provided.

Patent Literature 3 discloses an air compressor comprising a configuration where a soundproof case is divided into a mechanical chamber and an intake chamber, and both the chambers provide partial communication. An air compressor body, an engine that drives this body and a fan are arranged in the mechanical chamber of the soundproof case, and an aftercooler is disposed in the intake chamber.

CITATION LIST

Patent Literature

PATENT LITERATURE 1: JP-A-2016-133013
PATENT LITERATURE 2: JP-A-11-264391
PATENT LITERATURE 3: JP-A-2003-035260

SUMMARY OF INVENTION

Technical Problem

Here, a control device of a fluid machine comprising a compressor has a tendency that improvement of performances and addition of functions increase a number of components including semiconductor elements such as microchips and also increase high heat generation. Furthermore, for improvement of convenience, for example, a touch panel is mounted, as an input and output I/F (GUI) that enables a user operation, in a display unit of the control device. Cooling of the control device including an increased number of electric components that are sensitive to heat is an important problem. Particularly, in case of a package structure where the control device is mounted to a housing of the compressor, thermal influences of a compressor body and a drive source itself of this body also tend to be high. Consequently, it is necessary to consider a region to dispose the control device and how a cooling device is to be, in view of heat resistance and coolability.

A problem concerning the heat resistance and coolability in the control device can be solved by disposing the control device sufficiently away from a heating element or additionally providing the cooling device, but this problem also has a trade-off relation with a problem of size reduction of the fluid machine or complication or cost increase of equipment.

For example, in case where the control device is disposed away from the heating element, to satisfy demand for the machine size reduction, arrangements of the drive source, the compressor body, and pipes for a gas and various cooling devices need to be considered. A region that is less affected by heat is restricted as a location where the control device is to be disposed. Furthermore, such a region may not be sufficiently preferable for a cooling surface (ambient gas flowability or the like). Furthermore, a user input and output I/F comprising a touch panel to be installed in the housing imposes restrictions on an arrangement position also in terms of visibility and operability.

In the package type fluid machine, a technology of performing efficient cooling of a control system including the control device and the user input and output I/F is desired.

Solution to Problem

To solve the above problems, for example, a configuration according to claims is applied. That is, provided is a fluid machine comprising: a fluid machine body, a drive source that drives the fluid machine body, a control device, a housing in which at least the fluid machine body, the drive source and the control device are housed, and a cooling fan that generates cooling air in the housing, wherein the housing includes a plurality of intake openings through which the cooling air is introduced into the housing by the cooling fan, and at least an exhaust opening through which the cooling air is discharged, and includes a partition wall that partitions an interior of the housing into at least a first compartment and a second compartment and that includes a communication portion providing partial communication between the first compartment and the second compartment, a first intake opening among the plurality of intake openings is disposed in a housing wall of the first compartment in which at least the control device is disposed, and a second intake opening is disposed in a housing wall of the second compartment in which at least the drive source is disposed, the exhaust opening is configured to discharge the cooling air flowing from the first intake opening via the communication portion into the second compartment to cool at least one of the fluid machine body and the drive source, and the cooling air taken inside through the second intake opening, and the control device is disposed so that at least a part of the control device faces a region of the first compartment downstream of the first intake opening and upstream of the communication portion.

Advantageous Effects of Invention

It is possible to efficiently cool a control device while reducing increase in cooling device cost and increase in size of the device. Further problems, configurations or effects of the present invention will be clear from the following description.

DESCRIPTION OF EMBODIMENTS

Figure 1C:
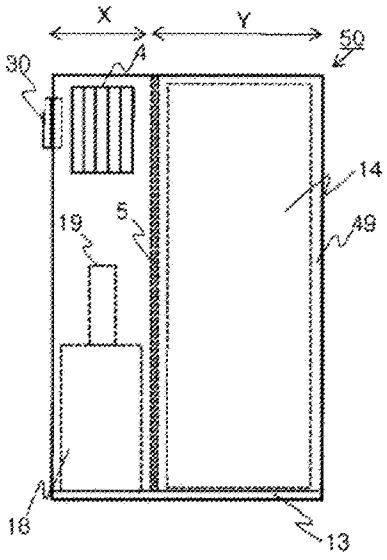
FIGS. 1A to 1E provide five views schematically showing a configuration of an air compressor according to Embodiment 1 to which the present invention is applied.
Figure 1A:
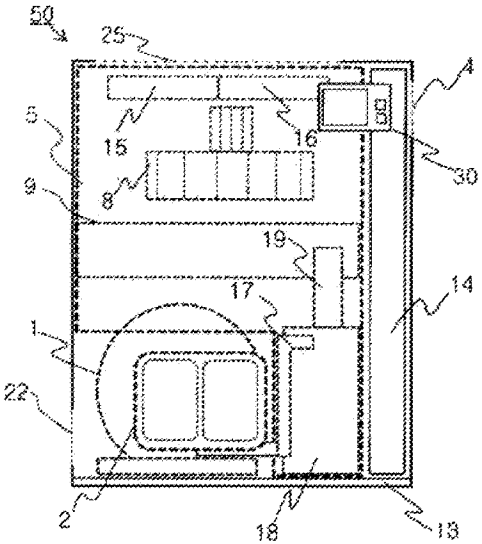
Figure 1B:
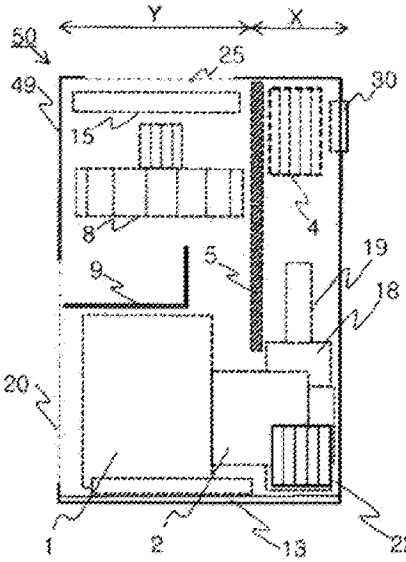
Figure 1E:
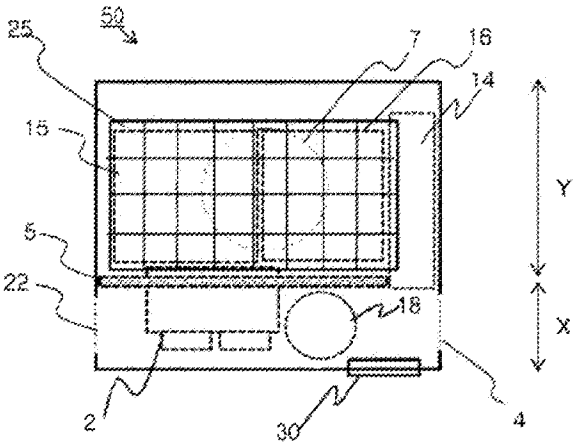
Figure 1D:
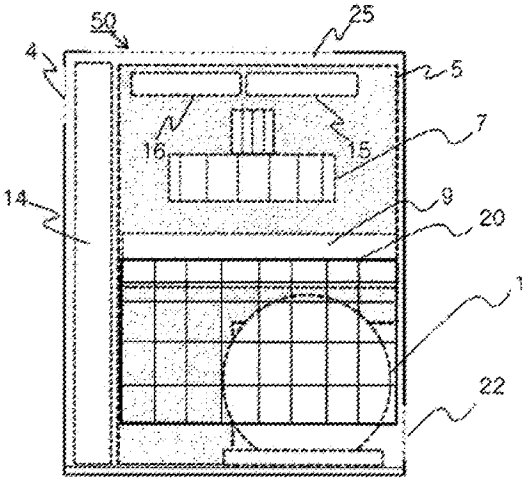

Hereinafter, description will be made as to aspect examples to carry out the present invention with reference to the drawings.

Embodiment 1

FIG. 1 provides five views schematically showing a configuration of an air compressor 50 (hereinafter, referred to simply as "the compressor 50" sometimes) of Embodiment 1 to which the present invention is applied. FIG. 1 shows respective views of (a) a front surface, (b) a left side surface, (c) a right side surface, (d) a rear surface, and (e) an upper surface, and shows perspective views of some members.

The compressor 50 mainly comprises an electric motor 1, a compressor body 2, an oil separator 18, a cooling fan 8, an oil cooler 15, an air cooler 16, a control device 30, and a drive control device 14, and includes a package configuration where these components are arranged on a base 13, and a circumference (in the present embodiment, a front surface, a rear surface, right and left side surfaces and an upper surface) is surrounded with a package panel 49.

The electric motor 1 is a drive source of the compressor body 2, receives power supply from outside or the like to rotate, and supplies rotation power to a compression mechanism of the compressor body 2 connected via an axis, a belt, a gear, a chain or the like. Note that the drive source may be equipment that converts energy of an internal combustion engine or the like into a rotational force. In the present embodiment, the coaxially connected electric motor 1 is applied.

The compressor body 2 comprises, for example, a screw rotor as the compression mechanism, and takes in air and discharges the compressed air by rotation of the rotor. In the present embodiment, it is considered that an oil supply type twin screw compressor body is applied. The oil supply type is configured to supply oil into a compressing operation chamber and discharge gas-liquid mixed gas together with compressed air.

The oil separator 18 is a gas-liquid separator, and separates air and oil from the gas-liquid mixed gas discharged via a discharge pipe 17. As a separation system, various systems such as a centrifugal (swivel) system and a collision system are applicable. The compressed air primarily separated from the oil by the oil separator 18 is then further separated (secondarily separated) from the oil through an air filter 19 comprising non-woven fabric or the like, to flow to an air cooler 16 side via a pipe.

The cooling fan 8 comprises a fan to be rotated and driven by an electric motor for the fan, and generates cooling air flowing among intake and exhaust openings as described later. As the fan, a turbo fan is applied, but various fan, for example, a propeller fan may be applied. Note that in the present example, a variable speed type electric motor for the fan by inverter control is applied, but a self-excited or constant speed type configuration where the rotational force of the electric motor 1 is used may be applied.

Each of the oil cooler 15 and the air cooler 16 comprises, for example, a heat exchanger, and is disposed downstream of the fan device 8 in a package (in the present example, on an upper surface side of the compressor 100) to perform heat exchange with the cooling air generated by the fan device 8. The oil cooler 15 cools the oil separated by the oil separator 18. Afterward, the cooled oil is circulated and supplied to the compressor body 1 via an unshown return path. The air cooler 16 is a cooling device that cools the compressed air having temperature raised due to a compressing operation, and cools the compressed air flowing through the oil filter 19 down to a predetermined temperature, the air being then supplied to a user side via a pipe. Note that a dryer may be disposed downstream of the air cooler 16 via the pipe.

The drive control device 14 is a device, for example, an inverter or a reactor that mainly controls power to be supplied to the electric motor 1. In the present embodiment, such a device is configured as a space partitioned from the compressor body or the like. Specifically, the space having a height from the base 13 to a vicinity of an upper surface along a right side of the compressor 50 and a depth from a rear surface side to a front of a region reaching a first compartment X described later is an arrangement location that is partitioned by a panel or the like and in which the device is disposed.

The control device 30 is a device that processes a control instruction of the compressor 50. The control device 50 includes a functional unit achieved by cooperation of an analog circuit configuration, program and semiconductor processing device, and a storage unit that stores various types of control information. The control device receives inputs of detected values from a pressure sensor and a temperature sensor (not shown) arranged on the pipe of the compressor 50, and in response to these inputs, the control device outputs a frequency instruction to the inverter of the drive control device 14 or the like, and executes operation control, for example, to open and close a valve body (not shown) disposed on an air pipe or a liquid pipe. Furthermore, the control device comprises an input I/F unit that accepts an input of an operation instruction from the outside, for example, a user operation, a display unit that displays a discharge temperature and various types of control information, a communication control unit that communicates with external equipment in a wireless or wired manner, and the like. Note that in the present embodiment, the input I/F unit and the display unit are touch panels.

Here, description will be made as to a configuration of an interior space of the compressor 50. In the compressor 50 surrounded with the package panel 49, a partition wall 5 extending in a vertical direction is disposed. The partition wall 5 is a plate member that partitions the interior space of the compressor 50 into at least the first compartment X and a second compartment Y. The partition wall 50 has a surface directed to the front surface and rear surface of the compressor 50, and extends from an interior upper surface toward a base 13 side at a width almost equal to that of the interior space of the compressor 50 (in a right-left direction in FIG. 1, (a)). The partition wall 5 partitions the interior of the compressor 50 into the first compartment X on the front surface side and the second compartment Y on the rear surface side. Furthermore, a part of the partition wall 5 on a side below a center in a height direction (the base 13 side) extends so that the first compartment X and the second compartment Y communicate as the space, without extending to the base 13. Specifically, when observed from a front surface direction, a part of the partition wall 5 extends downward to a position where the electric motor 1 and at least a part of the compressor body 2 overlap in a projection plane, and the other part thereof extends to the base 13. Consequently, a communication portion 7 is disposed between the first compartment X and the second compartment Y, and the cooling air can flow through this portion.

As to depth dimensions of the first compartment X and the second compartment Y (the width from the surface of the partition wall 5 in the vertical direction), the depth dimension of the second compartment Y (see FIG. 1, (b) and (c)) is larger than the depth dimension of the first compartment X. The first compartment X is a region where at least the control device 30 is disposed (note that in the present example, a part of the compressor body 2 in an axial direction, the oil separator 18 and the air filter 19 are also arranged in the first compartment X, but a part or all of this configuration may be disposed on a second compartment Y side). Furthermore, the second compartment Y is a region where the electric motor 1, the compressor body 2, the cooling fan 8, the oil cooler 15 and the air cooler 16 are arranged.

The control device 30 is disposed so that a front surface side (a touch panel arrangement side) of the control device is exposed out of the package panel 49, on a front surface of the package panel 49 and close to the right side thereof and a remaining part of the control device is disposed on an interior side of the package panel 49 (the first compartment X). More specifically, the compressor 50 includes an opening having a predetermined size in a location of the package panel 49 in which the control device 30 is disposed, and the control device 30 is disposed in the opening.

On the front surface side of the control device 30, functions of the input I/F unit and the display unit including the touch panel, the button and the like are arranged. Consequently, the input I/F unit and the display unit are arranged at comparatively high positions of the front surface in consideration of conveniences such as user's operability and visibility.

On the interior side of the package panel 49 (the first compartment X), a board part is located in which components such as a computation device, a storage device and a capacitor are mounted. That is, at least a part of the control device 30 is located in the space of the first compartment X.

Note that in the present embodiment, the touch panel and a substrate part are packaged almost as a housing made of a resin, a metal or the like, but all or a part of the substrate part may be exposed in the package.

Next, configurations of the intake and exhaust openings of the compressor 50 will be described.

The compressor 50 includes three intake openings (a first intake opening 4, a second intake opening 20 and a third intake opening 22) and one exhaust opening (an exhaust opening 25). The first intake opening 4 and the third intake opening 22 are arranged in a housing wall that forms the first compartment X, the first intake opening 4 is disposed in the partition wall 5 above the communication portion 7 in the height direction, and the third intake opening 22 is disposed at a position equal to a position of the communication portion 7 in the height direction. The second intake opening 20 and the exhaust opening 25 are arranged in a housing wall that forms the second compartment Y, the second intake opening 20 extends downward from a position close to a center of the rear surface in the height direction, and the exhaust opening is disposed in a vicinity of a center of the upper surface of the housing.

By the rotation of the cooling fan 8, a pressure on an intake side of the second compartment Y becomes negative, and outside air flows through these intake openings to the first compartment X and the second compartment Y.

The first intake opening 4 is opened in an upper front position of a right side surface of the compressor 50 (on the front surface side), and configured to introduce the outside air into the first compartment X. As one of characteristics of the present embodiment, the control device 30 is disposed in a middle of a cooling air flow path from the first intake opening 4 to the communication portion 7. Particularly, in the present embodiment, the control device 30 is disposed in a region of a vicinity of the first intake opening 4 upstream of the flow path. That is, the outside air just flowing inside through the first intake opening 4 flows along an interior surface of the control device 30, to achieve improvement of coolability of the control device 30.

The third intake opening 22 is opened in a lower part of a left side surface of the compressor 50, and configured to introduce the outside air into the first compartment X. The third intake opening 22 is located in a position that faces a left side surface of the compressor body 2 at an output side end, and the outside air just flowing inside contacts the left side surface of the compressor body 2 to acquire coolability of the compressor body 2 or the electric motor 1. The outside air flowing inside through the third intake opening 22 then flows to a cooling fan 8 side via the communication portion 7.

Here, as another characteristic of the present embodiment, an opening area of the communication portion 7 through which the cooling air can flow is larger than that of the first intake opening 4 or larger than a sum of opening areas of the first intake opening 4 and the third intake opening 20. According to such a configuration, a speed of the outside air just flowing inside through the first intake opening 4 increases, and cooling efficiency of the control device 30 can improve. Details will be described later.

The second intake opening 20 is opened in the rear surface of the compressor 50, and configured to introduce the outside air into the second compartment Y. The second intake opening 20 is an intake opening through which the cooling air of the oil cooler 15, the air cooler 16, the electric motor 1 and the like arranged in the second compartment Y is introduced. In the present embodiment, the opening is a rectangular opening having a height from a center of the rear surface of the compressor 50 in the height direction to a vicinity of a front of the base 13 and a width almost equal to a width of the second compartment Y (a right-left direction of FIG. 1, (d)). Furthermore, as shown in FIG. 1, (b) and the like, a duct 9 is disposed in the second compartment Y, and the outside air flowing inside through the second intake opening 20 is distributed to an upper side of the second compartment Y in which the oil cooler 15 and the air cooler 16 are arranged, and a lower side of the second compartment Y in which the electric motor 1 is disposed.

Specifically, the duct 9 comprises a plate member having about the same width as a width of the second intake opening 20, and extending from the second intake opening 20 toward the partition wall 5 in a horizontal direction. The duct 9 also extends to acquire a predetermined void from the partition wall 5 so that the cooling air distributed through the second intake opening 20 or the like to an electric motor 1 side flows to the cooling fan 8 side. Furthermore, an extending tip to the partition wall 5 in the horizontal direction has a rising shape to extend in parallel with the partition wall 5. Consequently, a rectification effect can be expected in a joining region with the outside air distributed by the duct 9 and flowing to the electric motor 1 side.

Next, flow of the cooling air of the compressor 50 will be described in detail.

Figure 2A:
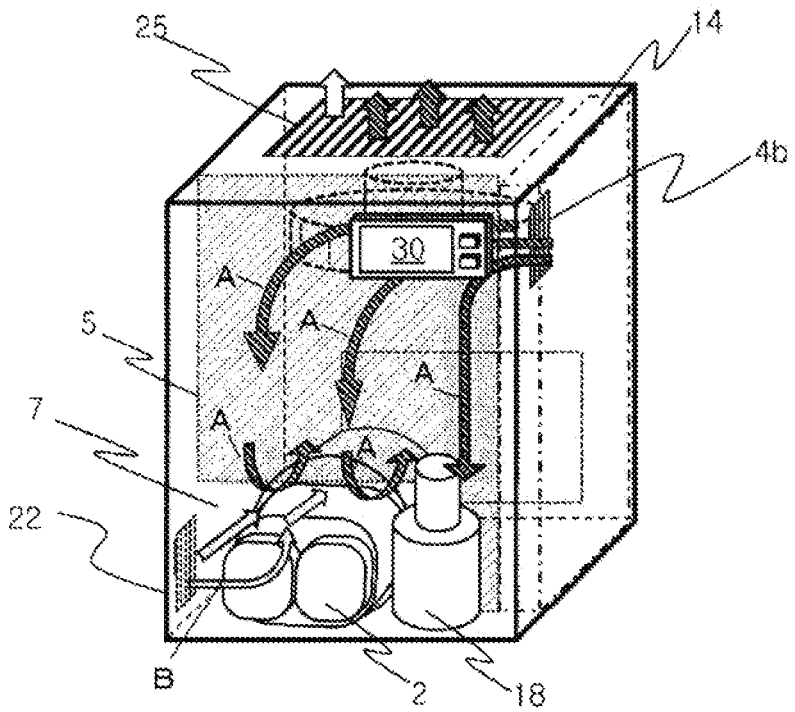
FIGS. 2A and 2B are perspective views schematically showing the configuration of the air compressor and flow of cooling air according to Embodiment 1.
Figure 2B:
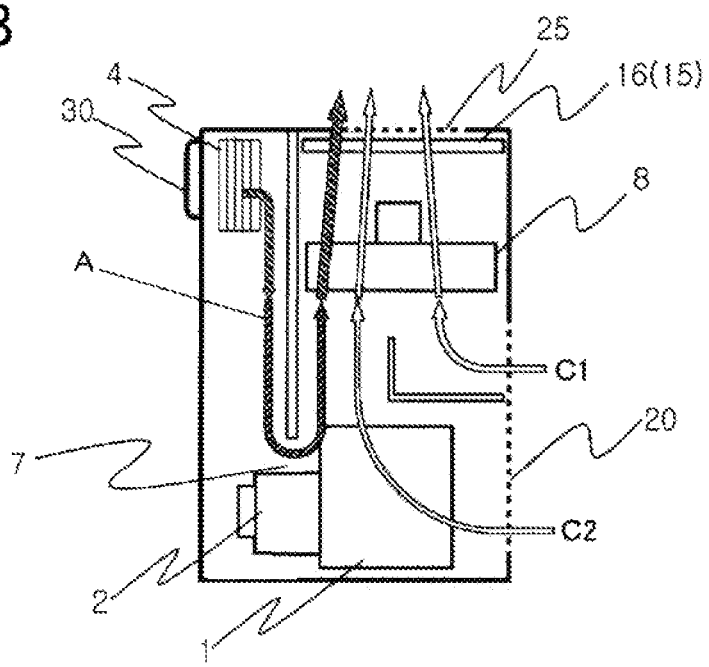

FIG. 2 schematically shows a behavior that the outside air flowing inside through the first intake opening 4 flows into the compressor 50. As shown in a perspective view of FIG. 2, (a), cooling air A flowing through the first intake opening 4 into the first compartment X flows along a surface of the control device 30 disposed in a vicinity of the opening on a back surface side, then flows toward the communication portion 7 while gradually changing its direction downward, and eventually flows from the communication portion to the second compartment Y. As shown in a right side perspective view of FIG. 2, (b), the cooling air A flowing from the communication portion 7 to the second compartment Y flows along a surface on an upper surface side of the compressor body 1 and an output shaft side of the electric motor 1, then flows along a rear surface of the partition wall 5 to the cooling fan 8, and is eventually discharged through the exhaust opening 25 to the outside. That is, the cooling air A flows from a right side surface direction of the compressor 50 into the first compartment X, and eventually flows from a lower side of the first compartment X via the communication portion 7 to the second compartment Y while swiveling upward.

Note that cooling air B flowing inside through the third intake opening 22 flows along the left side surface and another surface of the compressor body 2, and flows via the communication portion 7 to the second compartment Y. Cooling air C1 and cooling air C2 flowing inside through the second intake opening 20 flow toward the cooling fan 8, respectively.

As seen also from FIG. 2, the control device 30 is disposed away from heating elements such as the electric motor 1 and the compressor body 2 in an up-down direction in an interior region of the compressor 50. An air layer of the first compartment X is present between the first compartment X where the control device 30 is disposed and the second compartment Y where the heating elements, such as the electric motor 1 and the compressor body 2, are arranged, and any air does not flow from the heating elements to the control device 30. Therefore, heat on the second compartment Y side is hard to conduct to the first compartment X, and this effect further improves if the cooling fan 8 operates. Thus, it can be considered that the compressor 50 has excellent coolability, so that the heat from the electric motor 1 and the like is noticeably hard to conduct to the control device 30.

Furthermore, in the present embodiment, the opening area of the first intake opening 4 is larger than the opening area of the communication portion 7 (the opening area through which the cooling air can flow). Consequently, there is tendency that a flow velocity of the outside air flowing inside through the first intake opening 4 on an upstream side is higher than a flow velocity of the air flowing to the second compartment Y in the communication portion 7. In particular, this tendency further heightens, if a total area of the first intake opening 4 and the third intake opening 22 upstream of the communication portion 7 is larger than the opening area of the communication portion 7. Therefore, the cooling air having higher flow velocity contacts the control device 30 in a vicinity of the first intake opening 4 on a downstream side, which effectively improves cooling effect.

Furthermore, Embodiment 1 includes a configuration where a part of the compressor body 2 (a part of a discharge side) or the like is disposed in (protrudes to) the first compartment X. In other words, a depth of the compressor 50 mainly includes dimensions of main components that form the compressor, and a depth of the configuration of the first compartment X does not require any extra dimension. Consequently, it can be considered that the configuration of the first compartment X or the like contributes to size reduction of the compressor 50 while improving the coolability of the control device 30.

Finally, deflection means of the first intake opening 4 will be described.

Figure 3A:
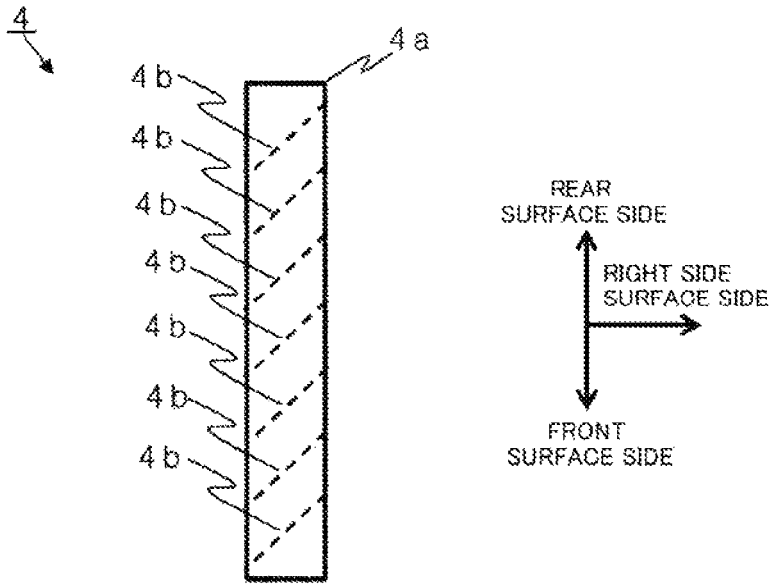
FIGS. 3A to 3C are schematic views showing a configuration of deflection means and flow of the cooling air according to Embodiment 1.
Figure 3B:
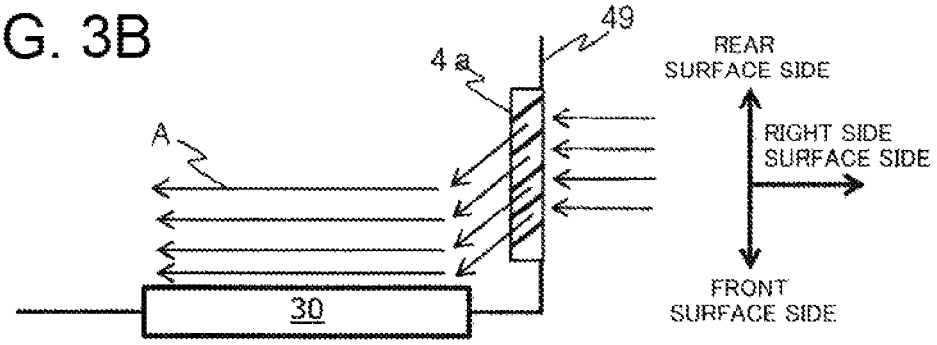
Figure 3C:
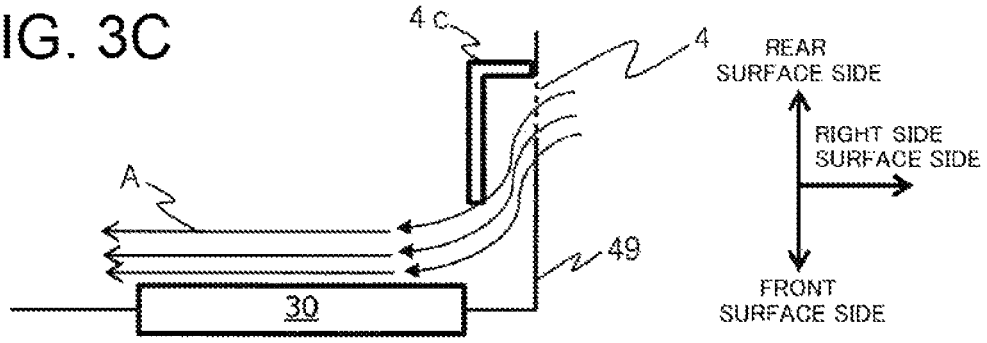

In FIG. 3, (a) is an upper surface perspective view schematically showing a fin structure of the first intake opening 4. The first intake opening 4 includes a plurality of deflection fins 4*b* in an up-down direction in a rectangular frame body 4*a*. Each of the deflection fins 4*b* has an interior side end inclined from an exterior side end toward a front surface side of the compressor 50. In other words, as shown in FIG. 3, (b), the outside air flowing inside through the first intake opening 4 opened along the right side surface of the compressor 50 flows inside while changing its direction to a control device 30 side. This increases a volume of air that contacts a surface of the control device 30, and achieves further improvement of coolability.

Furthermore, the first intake opening 4 is directed diagonally from the side surface of the compressor 50 in a rear surface direction by the deflection fins 4*b*. That is, sound transmitted from the first intake opening 4 to the outside, such as intake sound, or mechanical sound transmitted from an interior of the package to the outside, tends to conduct to an exterior rear surface side of the compressor 50, and an effect of preventing the sound from being diffused to the front surface side can be expected.

In FIG. 3, (c) is an upper surface perspective view showing another example of the deflection means. In the present example, the first intake opening 4 is not provided with the deflection fins 4*b* or the like, and in the first compartment X, for example, an L-shaped deflection duct 4*c* that forms a flow path toward the control device 30 is disposed. Also, in this configuration, the volume of the cooling air to the control device 30 side can be increased, and mechanical sound can be inhibited from being diffused to the outside by a crank structure of the deflection duct 4*c*. The deflection duct 4*c* may have a cylindrical or semi-cylindrical duct shape.

Note that both of the deflection duct 4*c* and the deflection fin 4*b* may be combined.

As described above, according to the compressor 50 of Embodiment 1, the size reduction of the compressor can be achieved, and the coolability of the control device 30 can be noticeably improved while suppressing complication or cost increase in cooling structure.

Furthermore, the first compartment X performs a function of the air layer against the heat of the heating elements of the second compartment Y, and provides a structure where heat is not easily propagated. For example, radiant heat of the second compartment Y having a comparatively high temperature does not easily conduct to the control device 30. Furthermore, the cooling fan 8 is driven, so that air flow from the second compartment Y to a first compartment X side becomes almost zero, and coolabilities of control devices 30*a* and 30*b* noticeably improve.

Additionally, according to the compressor 50 of Embodiment 1, the opening area of the communication portion 7 (the opening area through which the cooling air can flow) is larger than the sum of all areas of the first intake opening 4 and the third intake opening 22. Consequently, there are effects that a velocity of the cooling air flowing into the vicinity of the first intake opening 4 increase and that cooling efficiencies of the control devices 30*a* and 30*b* increase.

Furthermore, according to the compressor 50 of Embodiment 1, the control device is disposed on the upper side in the front surface of the first compartment X, and some of the components including the oil separator 18 are arranged in a space on the lower side, while acquiring user's convenience. Additionally, the components can be cooled with cooling air passing the surface of the control device 30. There is an effect that size reduction due to effective use of the space, and coolability can be acquired.

In addition, according to the compressor 50 of Embodiment 1, the first compartment X is also the space that forms the air layer, and hence a soundproofing effect of inhibiting mechanical sound or operation sound of the compressor 50 from being propagated from the front surface side of the compressor 50 to the outside can be expected.

Embodiment 2

Next, description will be made as to Embodiment 2 to which the present invention is applied. Note that members and the like having the same functions as in Embodiment 1 are denoted with the same reference signs, and detailed description may be omitted.

Figure 4A:
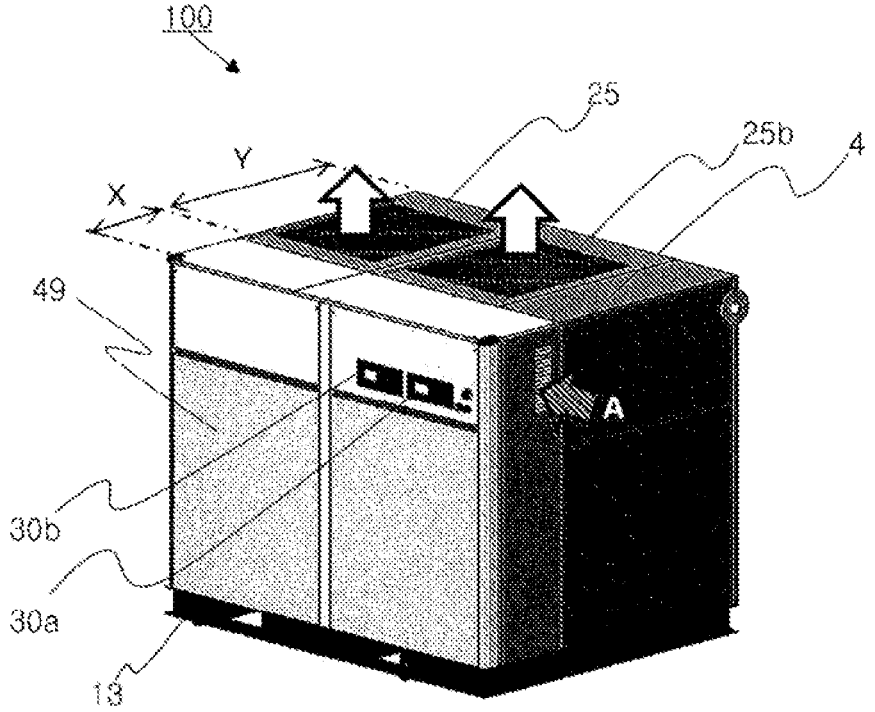
FIGS. 4A and 4B are perspective views showing an appearance configuration of an air compressor according to Embodiment 2 to which the present invention is applied.
Figure 4B:
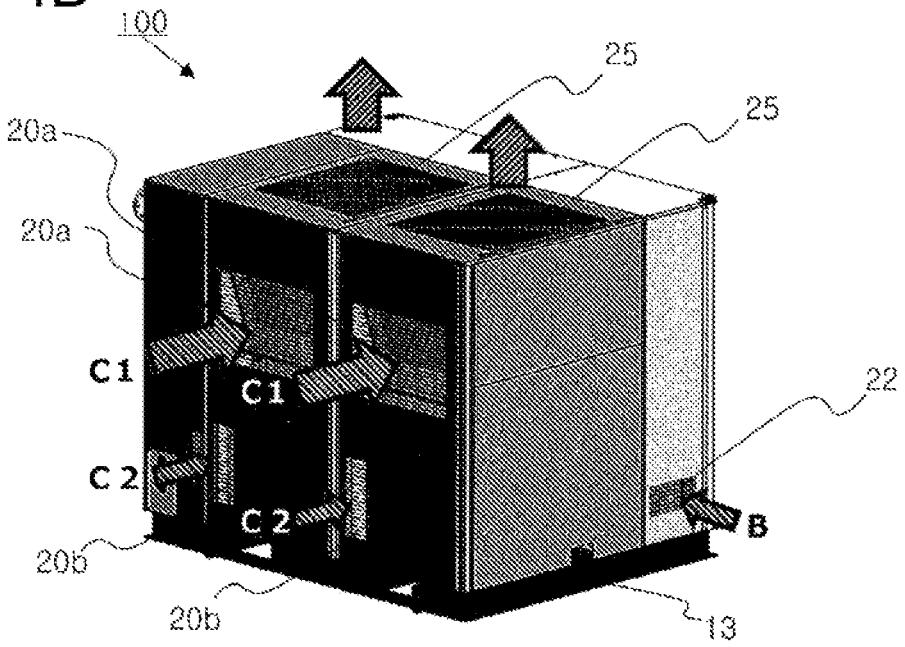
Figure 5A:
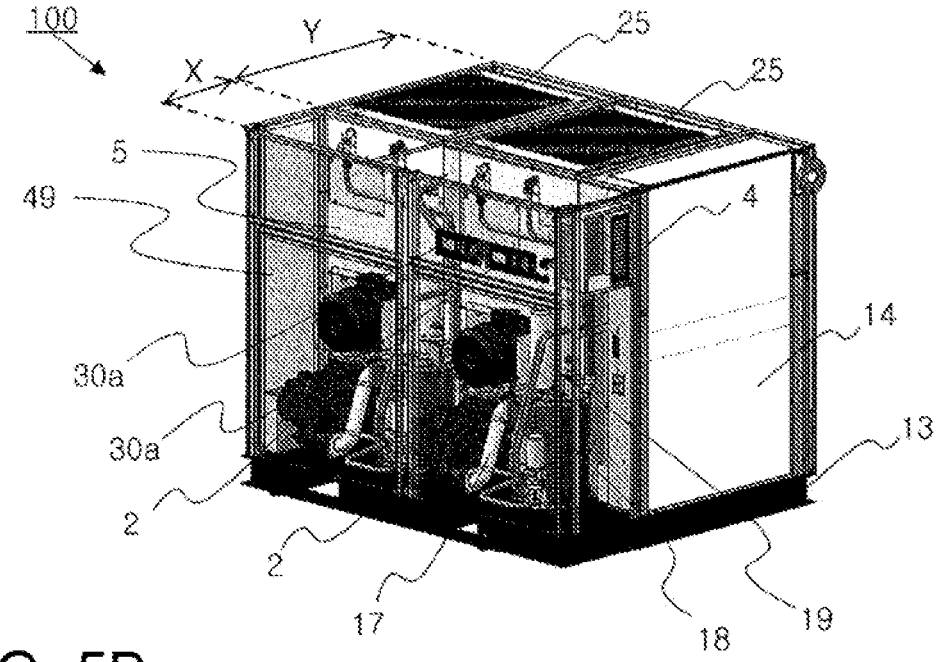
FIGS. 5A and 5B are perspective views showing a configuration of the air compressor according to Embodiment 2.
Figure 5B:
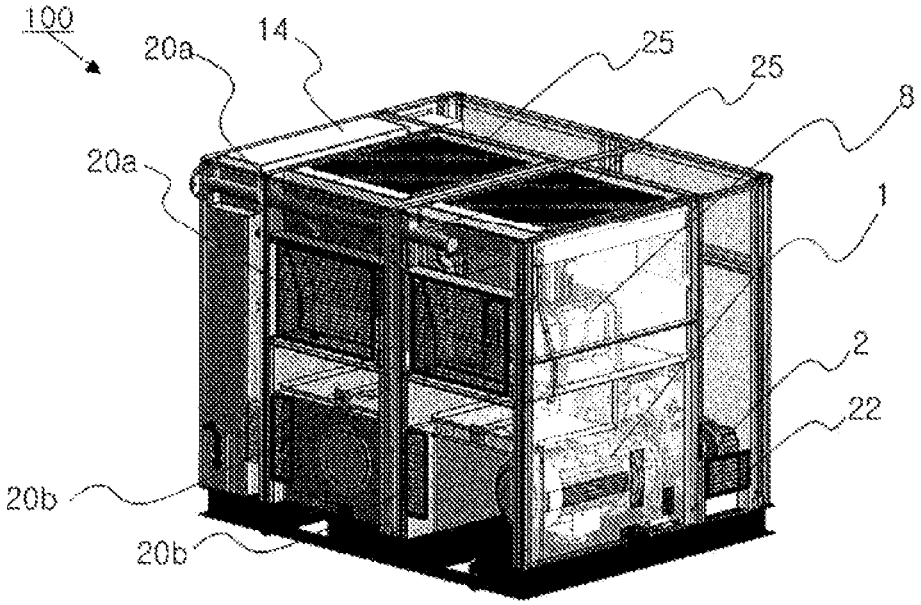

FIG. 4 is a perspective view showing an appearance configuration of an air compressor 100 to which the present invention is applied (hereinafter, referred to simply as "the compressor 100" sometimes), and FIG. 5 is a perspective view of the compressor 100. In both drawings, (a) is a perspective view showing a left front as a front surface, and (b) is a perspective view showing a left front as a rear surface. The compressor 100 is a compressor of a so-called dual configuration, and includes a schematic configuration where the compressors 50 of Embodiment 1 are arranged in parallel so that side surfaces of main components of the compressors face each other.

Thus, if a compressor unit that is a control target increases, a control device accordingly increases in size, a plurality of devices are required, and an amount of heat to be generated also increases. Therefore, a cooling structure is desired without increasing equipment size or increasing expansion cost of an equipment structure.

Hereinafter, a configuration will be specifically described.

Figure 6B:
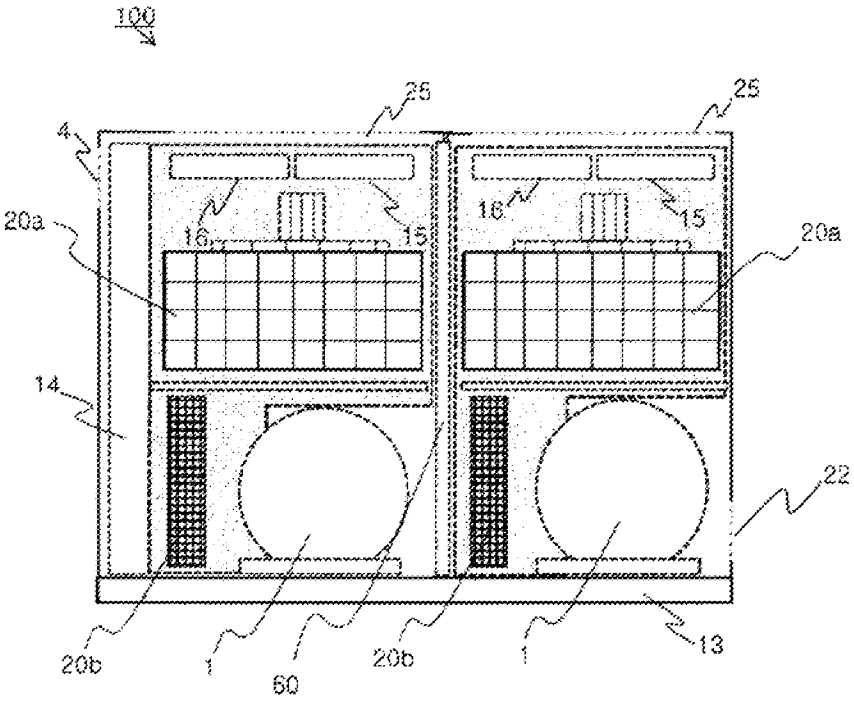
FIGS. 6A and 6B provide a left side view and a rear view schematically showing the configuration of the air compressor according to Embodiment 2.
Figure 6A:
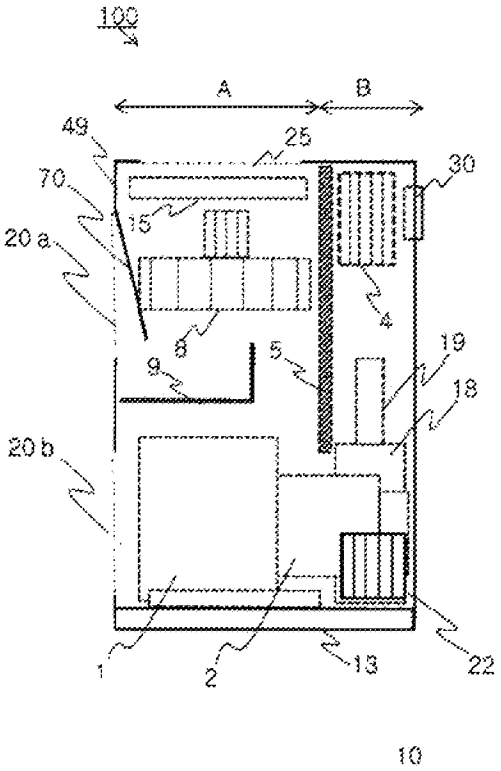

In FIG. 6, (a) is a perspective view schematically showing a left side surface of the compressor 100, and FIG. 6, (b) is a perspective view schematically showing the front surface. The compressor 100 is a compressor comprising two compressor units each including an electric motor 1, a compressor body 2 and others, on a base 13. Each of the compressor units comprises the electric motor 1, the compressor body 2, a discharge pipe 17, an oil separator 18, an air filter 19, a drive control device 14, a control device 30 and others. Note that the drive control device 14 common for both the units is disposed in a right side surface.

The compressor 100 is configured to join compressed air discharged from respective compressor bodies 2 to an internal pipe and provide the joined air to a user side, but alternatively, the compressor may discharge compressed air from separate systems to the user side. Furthermore, it is described in Embodiment 2 that both units are variable speed controllers by inverters, but alternatively, one or both of the units may be a constant speed machine.

The compressor 100 includes almost twice the device configuration of Embodiment 1, and hence the control device 30 comprises two control devices 30*a* and 30*b*. The control devices 30*a* and 30*b* are arranged on an upper right side of the front surface in the same manner as in Embodiment 1, and arranged in parallel in a lateral direction. Note that the respective control devices 30*a* and 30*b* may be arranged in parallel in an up-down direction. Alternatively, one control device housing may comprise control components for two devices. It is considered in Embodiment 2 that the respective control devices 30*a* and 30*b* control the compressor units, respectively, but alternatively, part of the control may be performed by the other control device.

In the compressor 100, as to depth (from the front surface to the rear surface) dimensions of a first compartment X in which the control devices 30*a* and 30*b* are arranged and a second compartment Y in which the electric motor 1, the compressor body 2, a cooling fan 8 and others are arranged, the dimension of the second compartment Y is larger than that of the first compartment X in the same manner as in Embodiment 1.

In the first compartment X, a space from a first intake opening 4 to a third intake opening 22 is a continuous space in the same manner as in Embodiment 1. Furthermore, a partition wall 5 comprises a communication portion 7 for each compressor unit. Specifically, a part of the compressor body 1 on a discharge side is disposed in a region of the first compartment X in the communication portion in the same manner as in Embodiment 1, and the communication portion 7 is located around a part of the partition wall 5 that overlaps with a part of the compressor body 2 in a vertical direction. The communication portion 7 is a rectangular opening that is larger as much as a predetermined area than an outer circumference of the compressor body 2.

On the other hand, the second compartment Y is divided into spaces of the respective compressor units by a partition wall 60. The partition wall 60 is a plate member that partitions the second compartment into a space from the partition wall 5 to a package panel 49 on a rear surface side and a space from the package panel 49 on an upper surface side to the base 13. That is, the second compartment Y is provided independently for each compressor unit, and a flow path of cooling air is provided independently for each second compartment Y.

In such a housing configuration, the first intake opening 4 is opened on an upper side of the right side surface of the compressor 100, and the third intake opening 22 is opened on a lower side of the left side surface of the compressor 100.

A third intake opening comprises a second intake opening 20*a* through which outside air is introduced into an upper side (a flow path through which the air flows directly to the cooling fan) of a flow path divided in an up-down direction by a duct 9, and a second intake opening 20*b* through which the outside air is introduced to a lower side (a flow path through which the air flows to the electric motor 1 and then flows to the cooling fan 8).

Each of the second intake openings 20*a* and 20*b* is opened for each second compartment Y of each compressor unit divided by the partition wall 60 in the rear surface of the compressor 100. Here, the second intake opening 20*b* to introduce the outside air into the electric motor 1 is opened close to a left side of a position of the electric motor 1 when observed from a rear surface direction. Furthermore, the second intake opening 20*b* is a rectangular opening having its height larger than its width, and is disposed in a shape and position so that the introduced outside air easily flows along a counter output side of the electric motor 1 and an outer circumferential surface thereof when seen from the rear surface side.

The second intake opening 20*a* is opened in a position where a projection plane in a horizontal direction observed from the rear surface (or the front surface) is above the duct 9 and partially overlaps with the cooling fan 8. The second intake opening 20*a* is a rectangular opening having a height to overlap with the duct 8 and almost all blade portions of the cooling fan 8 and a width slightly smaller than a width of the second compartment Y in the projection plane. Furthermore, a duct 70 extending diagonally downward from an upper end of the second intake opening 20*a* to the second compartment Y is disposed in the rear surface side package panel 49 on a second compartment Y side. A terminal end of the duct 70 forms a predetermined space from the duct 9 in a height direction and extends to a region of the cooling fan 8 on an intake side, to form a flow path through which the outside air introduced through the second intake opening 20*a* flows to the cooling fan 8.

Figure 7:
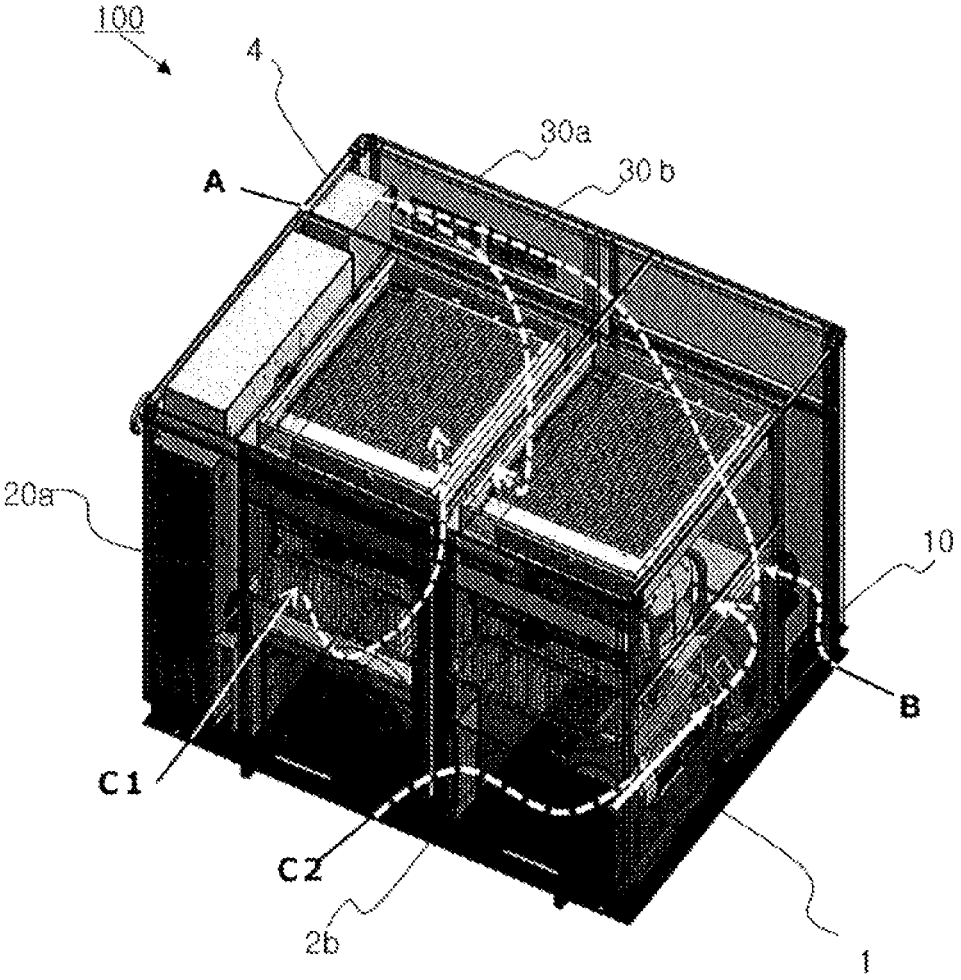
FIG. 7 is a perspective view schematically showing flow of cooling air of the air compressor according to Embodiment 2.

FIG. 7 shows flow of cooling air in the compressor 100 including the above described configuration. Cooling air A flowing inside through the first intake opening 4 is deflected by deflection means, and flows toward rear surface sides of the control devices 30*a* and 30*b*. The cooling air passing the rear surfaces of the control devices 30*a* and 30*b* then flows toward the communication portion 7 in a width direction and downward in the first compartment X. Afterward, the cooling air flows via the communication portion 7 to the second compartment Y, swivels toward the intake side of the cooling fan 8 to form rising flow along a rear surface of the partition wall 5, passes through an oil cooler 15 and an air cooler 16, and is discharged through an exhaust opening 25 to outside.

Furthermore, cooling air C1 flowing inside through the second intake opening 20*a* is guided by the ducts 9 and 70 to flow to the intake side of the cooling fan 8, performs heat exchange with the oil cooler 15 and the air cooler 16, then passes through the oil cooler 15 and the air cooler 16, and is discharged through the exhaust opening 25 to the outside (FIG. 7 only shows the cooling air C1 on a side of one of the compressor units). Cooling air C2 flowing inside through a second intake opening 2*b* flows through a space of the second compartment Y in which the electric motor 1 and others are arranged, and then flows through a space between the duct 9 and the partition wall 5 to flow to the intake side of the cooling fan 8 (FIG. 7 only shows the cooling air C2 on the side of the one compressor unit).

Furthermore, cooling air B flowing inside through the third intake opening 22 flows along the upper, lower, side and front surfaces of each compressor body 2, and flows via each communication portion 7 to the second compartment Y. Afterward, the cooling air, in the same manner as in the cooling air A, flows along the rear surface of the partition wall 5 toward the intake side of the cooling fan 8 to form rising flow, passes through the oil cooler 15 and the air cooler 16, and is discharged through the exhaust opening 25 to the outside (FIG. 7 only shows the cooling air B on the side of the one compressor unit).

Thus, according to the compressor 100 of Embodiment 2, in addition to the effects of Embodiment 1, there are effects as follows. Even in the configuration where a plurality of compressor units are housed in one package housing, there is an effect of improving coolabilities of the control devices 30*a* and 30*b* while suppressing complication or cost increase in a cooling structure.

Additionally, according to the compressor 100 of Embodiment 2, the first compartment X forms a continuous space over a plurality of compressor units on a front surface side, and hence the cooling air flowing inside through the first intake opening 4 and the cooling air flowing inside through the third intake opening 22 flow via the respective communication portions 7 into the second compartments, respectively. Total volumes of the cooling air flowing through the respective second compartments Y can be almost equal. That is, a total volume of the cooling air that cools the oil cooler 15 and the air cooler 16 can be also equal. Furthermore, for example, in case where one of the compressors performs a full speed operation while the other compressor unit stops or performs a degenerating operation, i.e., even if there is a difference in number of rotations of the cooling fan 8, the coolabilities of the control devices 30*a* and 30*b* can be acquired.

The embodiments to carry out the present invention have been described above, but the present invention is not limited to the above various examples, and various configurations can be applied without departing from gist of the present invention.

For example, in the above examples, the air compressor has been described as the fluid machine, but the present invention may be applied to another fluid machine such as a blower or a pump expander (an expansion generator or the like). Furthermore, the present invention is not limited to the air compressor, and can be applied to a compressor that compresses another gas. Additionally, the present invention can be applied not only to the oil supply type compressor but also to a compressor that supplies another liquid (e.g., water) to a compressing operation chamber. In addition, the present invention is not limited to a screw (a single, twin or multi-screw) as a compressor body form, and may be applied to a turbo type or another displacement type compression mechanism.

Furthermore, in the above examples, an opening position of the first intake opening 4 is in the compressor side surface, but may be on the front surface side of the compressor. In this case, to acquire the coolabilities of the control devices

30, 30*a* and 30*b*, it is preferable that deflection means for sufficient flow of the cooling air A is provided in each of the surfaces of the control devices on the back surface side (the first compartment X side).

Additionally, in the above examples, the third intake opening 22 to introduce the outside air into the first compartment X is provided, but presence, position and size of the intake opening are arbitrary in accordance with specifications of the compressor.

In addition, according to the above embodiments, the opening area of the communication portion 7 through which the cooling air can flow is larger than the sum of all the opening areas of the first intake opening 4 and the third intake opening 22. However, even if the opening area of the communication portion 7 is equal or small, a constant effect of the present invention can be expected.

Furthermore, in the above embodiments, the electric motor 1 and the compressor body 2 are arranged in the axial direction from the front surface toward the rear surface, but may be arranged in an axial direction from the right side surface toward the left side surface.

The above descriptions have been made as to the embodiments, but the present invention is not limited to the embodiments. It is obvious for a person skilled in the art that various changes and modifications can be made without departing from the spirit of the present invention as defined by the appended claims.

REFERENCE SIGNS LIST

1 electric motor
2 compressor body
3 exhaust opening
4 first intake opening
4*a* frame body
4*b* fin
7 communication portion
8 cooling fan
9 duct
13 base
14 drive control device
15 oil cooler
16 air cooler
17 discharge pipe
18 oil separator
19 air filter
20, 20*a*, and 20*b* second intake opening
22 second intake opening
25 exhaust opening
30, 30*a*, and 30*b* control device
49 package panel
50 air compressor
60 partition wall
70 duct
100 air compressor
A, B, C1, and C2 cooling air
X first compartment
Y second compartment

The invention claimed is:

1. A fluid machine comprising:
a fluid machine body,
a drive source that drives the fluid machine body,
a control device,
a housing in which at least the fluid machine body, the drive source and the control device are housed, and
a cooling fan that generates cooling air in the housing, wherein
the housing includes a plurality of intake openings through which the cooling air is introduced into the housing by the cooling fan, and at least an exhaust opening through which the cooling air is discharged, and
includes a partition wall that partitions an interior of the housing into at least a first compartment and a second compartment and that includes a communication portion providing partial communication between the first compartment and the second compartment,
a first intake opening among the plurality of intake openings is disposed in a housing wall of the first compartment in which at least the control device is disposed, and a second intake opening is disposed in a housing wall of the second compartment in which at least the drive source is disposed,
the exhaust opening is configured to discharge the cooling air flowing from the first intake opening via the communication portion into the second compartment to cool at least one of the fluid machine body and the drive source, and the cooling air taken inside through the second intake opening, and
the control device is disposed so that at least a part of the control device faces a region of the first compartment downstream of the first intake opening and upstream of the communication portion, wherein
the partition wall extends in a vertical direction in the housing, and
a part of the drive source or the fluid machine body is disposed in the first compartment via a part of the communication portion.

2. The fluid machine according to claim 1, wherein at least a part of the control device is disposed in a vicinity of the first intake opening.

3. The fluid machine according to claim 1, wherein the housing wall in which the control device is disposed is a housing front surface, while the housing wall in which the first intake opening is disposed is a housing side surface or upper surface.

4. The fluid machine according to claim 1, wherein the partition wall extends in a vertical direction in the housing,
the communication portion is disposed below a center of the partition wall in a height direction, and
the first intake opening is disposed above the communication portion in the height direction.

5. The fluid machine according to claim 4, wherein the exhaust opening is disposed above the communication portion in the height direction.

6. The fluid machine according to claim 1, wherein an opening area of the communication portion through which cooling air can flow is larger than an opening area of the first intake opening.

7. The fluid machine according to claim 1, wherein the partition wall extends in a vertical direction in the housing, and
at least a part of the drive source or the fluid machine body is disposed in a vicinity of the communication portion.

8. The fluid machine according to claim 1, wherein a width of the second compartment from a surface of the partition wall in a vertical direction is larger than a width of the first compartment in the vertical direction.

9. The fluid machine according to claim 1, further comprising:
deflection means for deflecting, toward at least a part of the control device, a direction of outside air flowing through the first intake opening into the first compartment.

10. The fluid machine according to claim 1, further comprising:

a third intake opening that is provided in the housing wall of the first compartment and through which outside air flows into the first compartment, wherein the third intake opening is disposed closer to the communication portion than the first intake opening is.

11. The fluid machine according to claim 1, wherein the first compartment is disposed on a front surface side in the housing, and the second compartment is disposed on a rear surface side of the first compartment.

12. The fluid machine according to claim 1, comprising a plurality of fluid machine units each including at least the drive source, the fluid machine body, the cooling fan and the control device, and the partition wall comprises a plurality of communication portions, wherein a first amount of the plurality of communication portions of the partition wall is equal to or greater than a second amount of communication portions of the fluid machine units.

13. The fluid machine according to claim 12, wherein the second compartment is independent for each of the plurality of fluid machine units, and the first compartment communicates with the plurality of communication portions.

14. The fluid machine according to claim 1, wherein the control device includes at least one of a computation unit, a storage unit, a display unit, an external communication I/F unit and an input unit.

15. The fluid machine according to claim 1, the fluid machine being one of a compressor, a blower, a pump, and an expander.

16. The fluid machine according to claim 1, the fluid machine being a gas compressor, wherein the gas compressor comprises a displacement type compressor or a turbo type compressor, the displacement type compressor includes a liquid supply type and a liquid-free type, and the displacement type compressor includes a screw type, a scroll type, a reciprocating type and a vane type.

* * * * *